US009316217B2

(12) United States Patent
Yamamoto et al.

(10) Patent No.: US 9,316,217 B2
(45) Date of Patent: Apr. 19, 2016

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Shinya Yamamoto, Kariya (JP); Takahiro Suzuki, Kariya (JP); Kazunari Honda, Kariya (JP); Kei Nishii, Kariya (JP); Yusuke Yamazaki, Kariya (JP); Masaki Ota, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 250 days.

(21) Appl. No.: 14/064,864

(22) Filed: Oct. 28, 2013

(65) Prior Publication Data

US 2014/0127045 A1 May 8, 2014

(30) Foreign Application Priority Data

Nov. 5, 2012 (JP) ..... 2012-243989

(51) Int. Cl.
*F04B 27/10* (2006.01)
*F04B 27/16* (2006.01)
*F04B 27/18* (2006.01)

(52) U.S. Cl.
CPC ..... *F04B 27/1804* (2013.01); *F04B 27/1054* (2013.01); *F04B 27/1072* (2013.01); *F04B 27/18* (2013.01); *F04B 2027/1813* (2013.01)

(58) Field of Classification Search
CPC ..... F04B 27/10; F04B 27/12; F04B 27/14; F04B 27/16; F04B 27/18; F04B 27/1054; F04B 27/1804; F04B 2027/1813; F04B 2027/1822; F04B 2027/1831
USPC ..... 417/222.1, 222.2, 269, 270
See application file for complete search history.

(56) References Cited

U.S. PATENT DOCUMENTS 3,062,020 A 11/1962 Heidorn
4,037,993 A 7/1977 Roberts
4,061,443 A * 12/1977 Black et al. ..... F04B 27/1072 184/6.17
4,174,191 A * 11/1979 Roberts ..... F04B 27/18 417/222.1

(Continued)

FOREIGN PATENT DOCUMENTS

CN 1075778 9/1993
CN 1225422 8/1999

(Continued)

OTHER PUBLICATIONS

International Preliminary Report on Patentability for PCT/JP2013/079679, mailed May 5, 2015.

(Continued)

*Primary Examiner* — Peter J Bertheaud
(74) *Attorney, Agent, or Firm* — Greenblum & Bernstein, P.L.C.

(57) ABSTRACT

In a compressor according to the present invention, an actuator is arranged in a swash plate chamber in a manner rotatable integrally with a drive shaft. The actuator includes a rotation body, a movable body, and a control pressure chamber. A control mechanism includes a bleed passage, a supply passage, and a control valve. The control mechanism is capable of changing the pressure in the control pressure chamber to move the movable body. When the pressure in the control pressure chamber exceeds the pressure in the swash plate chamber, the inclination angle of the swash plate with respect to the rotation axis of the drive shaft increases.

7 Claims, 6 Drawing Sheets

(56) References Cited

U.S. PATENT DOCUMENTS

| | | | | | |
|---|---|---|---|---|---|
| 4,886,423 | A | | 12/1989 | Iwanami et al. | |
| 4,932,843 | A | | 6/1990 | Itoigawa et al. | |
| 4,963,074 | A | * | 10/1990 | Sanuki | F04B 27/18 417/222.1 |
| 5,002,466 | A | | 3/1991 | Inagaki et al. | |
| 5,022,826 | A | * | 6/1991 | Matsuda | F04B 27/12 417/222.1 |
| 5,032,060 | A | * | 7/1991 | Kobayashi | F04B 27/12 417/222.1 |
| 5,259,736 | A | * | 11/1993 | Terauchi | F01B 3/106 417/222.1 |
| 5,370,503 | A | * | 12/1994 | Terauchi | F04B 27/1072 417/222.2 |
| 5,547,346 | A | * | 8/1996 | Kanzaki | F04B 49/022 417/222.2 |
| 5,882,180 | A | | 3/1999 | Kawaguchi et al. | |
| 6,142,745 | A | * | 11/2000 | Kawaguchi | F04B 27/1804 417/222.2 |
| 6,164,929 | A | | 12/2000 | Kazuya et al. | |
| 6,217,293 | B1 | * | 4/2001 | Murase | F04B 27/1804 417/222.2 |
| 6,517,321 | B1 | * | 2/2003 | Takenaka | F04B 27/0895 417/222.1 |
| 6,742,439 | B2 | | 6/2004 | Matsuda et al. | |
| 2002/0073722 | A1 | | 6/2002 | Ota et al. | |
| 2002/0127116 | A1 | | 9/2002 | Koelzer et al. | |
| 2006/0120882 | A1 | | 6/2006 | Jordan et al. | |
| 2008/0145239 | A1 | | 6/2008 | Murase et al. | |
| 2009/0064855 | A1 | | 3/2009 | Kayukawa | |
| 2012/0073430 | A1 | | 3/2012 | Uchikado | |
| 2012/0251344 | A1 | | 10/2012 | Kobayashi et al. | |
| 2014/0127042 | A1 | | 5/2014 | Yamamoto et al. | |
| 2014/0127045 | A1 | | 5/2014 | Yamamoto et al. | |

FOREIGN PATENT DOCUMENTS

| | | |
|---|---|---|
| CN | 1461384 | 12/2003 |
| CN | 2787875 | 6/2006 |
| CN | 101387278 | 3/2009 |
| DE | 10 2009 006 909 | 8/2010 |
| EP | 1 906 017 | 4/2008 |
| EP | 1 933 031 | 6/2008 |
| JP | 52-131204 | 11/1977 |
| JP | 53-69911 | 6/1978 |
| JP | 58-162780 | 9/1983 |
| JP | 62-225782 | 10/1987 |
| JP | 64-41680 | 2/1989 |
| JP | 1-147171 | 6/1989 |
| JP | 2-16374 | 1/1990 |
| JP | 2-19665 | 1/1990 |
| JP | 2-132876 | 11/1990 |
| JP | 3-10082 | 1/1991 |
| JP | 3-134268 | 6/1991 |
| JP | 4-54287 | 2/1992 |
| JP | 5-18355 | 1/1993 |
| JP | 5-172052 | 7/1993 |
| JP | 5-312144 | 11/1993 |
| JP | 2002-21722 | 1/2002 |
| JP | 2002-349431 | 12/2002 |
| JP | 2003-206856 | 7/2003 |
| JP | 2004-60473 | 2/2004 |
| JP | 2007-239722 | 9/2007 |
| JP | 2010-281289 | 12/2010 |
| JP | 2011-27013 | 2/2011 |
| KR | 2010-0013736 | 2/2010 |
| WO | 2006/023923 | 3/2006 |

OTHER PUBLICATIONS

U.S. Appl. No. 14/439,498, filed Apr. 29, 2015 to Hiroyuki Nakaima et al.

U.S. Appl. No. 14/064,632 to Shinya Yamamoto et al., filed Oct. 28, 2013.

U.S. Appl. No. 14/064,733 to Shinya Yamamoto et al., filed Oct. 28, 2013.

U.S. Appl. No. 14/064,424 to Shinya Yamamoto et al., filed Oct. 28, 2013.

U.S. Appl. No. 14/064,499 to Shinya Yamamoto et al., filed Oct. 28, 2013.

Office Action issued in Counterpart U.S. Appl. No. 14/064,733, dated Sep. 4, 2015.

European Search Report received in Application No. 13851030.0, mail date is Nov. 13, 2015.

China Official Action and English translation thereof, mail date is Jul. 31, 2015.

China Official Action in Application No. 201310524846.0 and English translation thereof, mail date is Aug. 5, 2015.

China Official Action in Application No. 201310525972.8 and English translation thereof, mail date is Aug. 5, 2015.

China Official Action in Application No. 201310524675.1 and English translation thereof, mail date is Sep. 25, 2015.

U. S. Official Action (Notice of Allowance) received in U.S. Appl. No. 14/064,424, dated Aug. 26, 2015.

U.S. Official Action (Notice of Allowance) received in U.S. Appl. No. 14/064,499, dated Aug. 28, 2015.

U.S. Official Action received in U.S. Appl. No. 14/064,632, dated Sep. 2, 2015.

U.S. Official Action received in U.S. Appl. No. 14/064,733, dated Sep. 4, 2015.

* cited by examiner

SWASH PLATE TYPE VARIABLE DISPLACEMENT COMPRESSOR

BACKGROUND OF THE INVENTION

The present invention relates to a swash plate type variable displacement compressor.

Japanese Laid-Open Patent Publications No. 5-172052 and No. 52-131204 disclose conventional swash plate type variable displacement type compressors (hereinafter, referred to as compressors). The compressors include a suction chamber, a discharge chamber, a swash plate chamber, and a plurality of cylinder bores, which are formed in a housing. A drive shaft is rotationally supported in the housing. The swash plate chamber accommodates a swash plate, which is rotatable through rotation of the drive shaft. A link mechanism, which allows change of the inclination angle of the swash plate, is arranged between the drive shaft and the swash plate. The inclination angle is defined with respect to a line perpendicular to the rotation axis of the drive shaft. Each of the cylinder bores accommodates a piston in a reciprocal manner and thus forms a compression chamber. A conversion mechanism reciprocates each of the pistons in the associated one of the cylinder bores by the stroke corresponding to the inclination angle of the swash plate through rotation of the swash plate. An actuator is capable of changing the inclination angle of the swash plate and controlled by a control mechanism.

The actuator is arranged in the swash plate chamber, while being rotational integrally with the drive shaft. Specifically, the actuator has a rotation body rotating integrally with the drive shaft. The interior of the rotation body accommodates a movable body, which moves in the direction of the rotation axis of the drive shaft and is movable relative to the rotation body. A control pressure chamber, which moves the movable body using the pressure in the control pressure chamber, is formed between the rotation body and the movable body. A communication passage, which communicates with the control pressure chamber, is formed in the drive shaft. A pressure control valve is arranged between the communication passage and a discharge chamber. The pressure control valve changes the pressure in the control pressure chamber to allow the movable body to move in the direction of the rotation axis relative to the rotation body. The rear end of the movable body is held in contact with a hinge ball. The hinge ball is arranged in a center of the swash plate and couples the swash plate to the drive shaft to allow the swash plate to pivot. A pressing spring, which urges the hinge ball in such a direction as to increase the inclination angle of the swash plate, is arranged at the rear end of the hinge ball.

The link mechanism includes a hinge ball and an arm, which is arranged between the rotation body and the swash plate. The hinge ball is urged by a pressing spring arranged rearward to the hinge ball and maintained in contact with the rotation body. A first pin, which extends in a direction perpendicular to the rotation axis, is passed through the front end of the arm. A second pin, which also extends in a direction perpendicular to the rotation axis, is inserted through the rear end of the arm. The arm and the first and second pins support the swash plate with respect to the rotation body in a pivotal manner.

When a pressure regulation valve of the compressor is controlled to open, communication between a discharge chamber and a pressure regulation chamber is allowed. This raises the pressure in the control pressure chamber compared to the pressure in a swash plate chamber. The movable body thus retreats and presses the hinge ball rearward against the urging force of the pressing spring. This pivots the swash plate to decrease the inclination angle of the swash plate. The piston stroke is thus decreased. As a result, the compressor displacement per rotation cycle is reduced.

In contrast, by controlling the pressure regulation valve to close, the communication between the discharge chamber and the pressure regulation chamber is blocked. This lowers the pressure in the control pressure chamber to a level equal to the pressure level in the swash plate chamber. The movable body is thus moved forward and the hinge ball is operated correspondingly by the urging force of the pressing spring. This pivots the swash plate in the opposite direction to the corresponding direction of the case where the inclination angle of the swash plate decreases. The inclination angle of the swash plate is thus increased to increase the piston stroke.

However, the above-described conventional compressor operates the actuator such that the inclination angle of the swash plate is increased by lowering the pressure in the control pressure chamber. This makes it difficult to raise the compressor displacement rapidly.

SUMMARY OF THE INVENTION

Accordingly, it is an objective of the present invention to provide a compressor that increases its displacement rapidly.

A swash plate type variable displacement compressor according to the present invention includes a housing in which a suction chamber, a discharge chamber, a swash plate chamber, and a cylinder bore are formed, a drive shaft rotationally supported by the housing, a swash plate rotatable in the swash plate chamber by rotation of the drive shaft, a link mechanism, a piston, a conversion mechanism, an actuator, and a control mechanism. The link mechanism is arranged between the drive shaft and the swash plate, and allows change of an inclination angle of the swash plate with respect to a line perpendicular to the rotation axis of the drive shaft. The piston is reciprocally received in the cylinder bore. The conversion mechanism causes the piston to reciprocate in the cylinder bore by a stroke corresponding to the inclination angle of the swash plate through rotation of the swash plate. The actuator is capable of changing the inclination angle of the swash plate. The control mechanism controls the actuator. The actuator is arranged in the swash plate chamber and rotates integrally with the drive shaft. The actuator includes a rotation body fixed to the drive shaft, a movable body that is connected to the swash plate and movable relative to the rotation body in the direction of the rotation axis of the drive shaft, and a control pressure chamber that is defined by the rotation body and the movable body and moves the movable body using pressure in the control pressure chamber. One of the suction chamber and the swash plate chamber is a low pressure chamber. The control mechanism has a control passage through which the control pressure chamber communicates with the low pressure chamber and the discharge chamber and a control valve capable of adjusting the opening degree of the control passage. At least a section of the control passage is formed in the drive shaft. The movable body is arranged such that the inclination angle of the swash plate is increased through a rise of the pressure in the control pressure chamber.

In this compressor, the inclination angle of the swash plate is rapidly increased by applying the pressure in the discharge chamber to the control pressure chamber through the control passage by means of the control valve. As a result, the compressor increases its displacement rapidly.

Additionally, in the compressor according to the present invention, at least a section of the control passage is formed in the drive shaft. This simplifies the configuration of the compressor and thus reduces the compressor in size.

DETAILED DESCRIPTION OF THE PREFERRED EMBODIMENTS

First to fourth embodiments of the present invention will now be described with reference to the attached drawings. A compressor of each of the first to fourth embodiments forms a part of a refrigeration circuit in a vehicle air conditioner and is mounted in a vehicle.

First Embodiment

Figure 1:
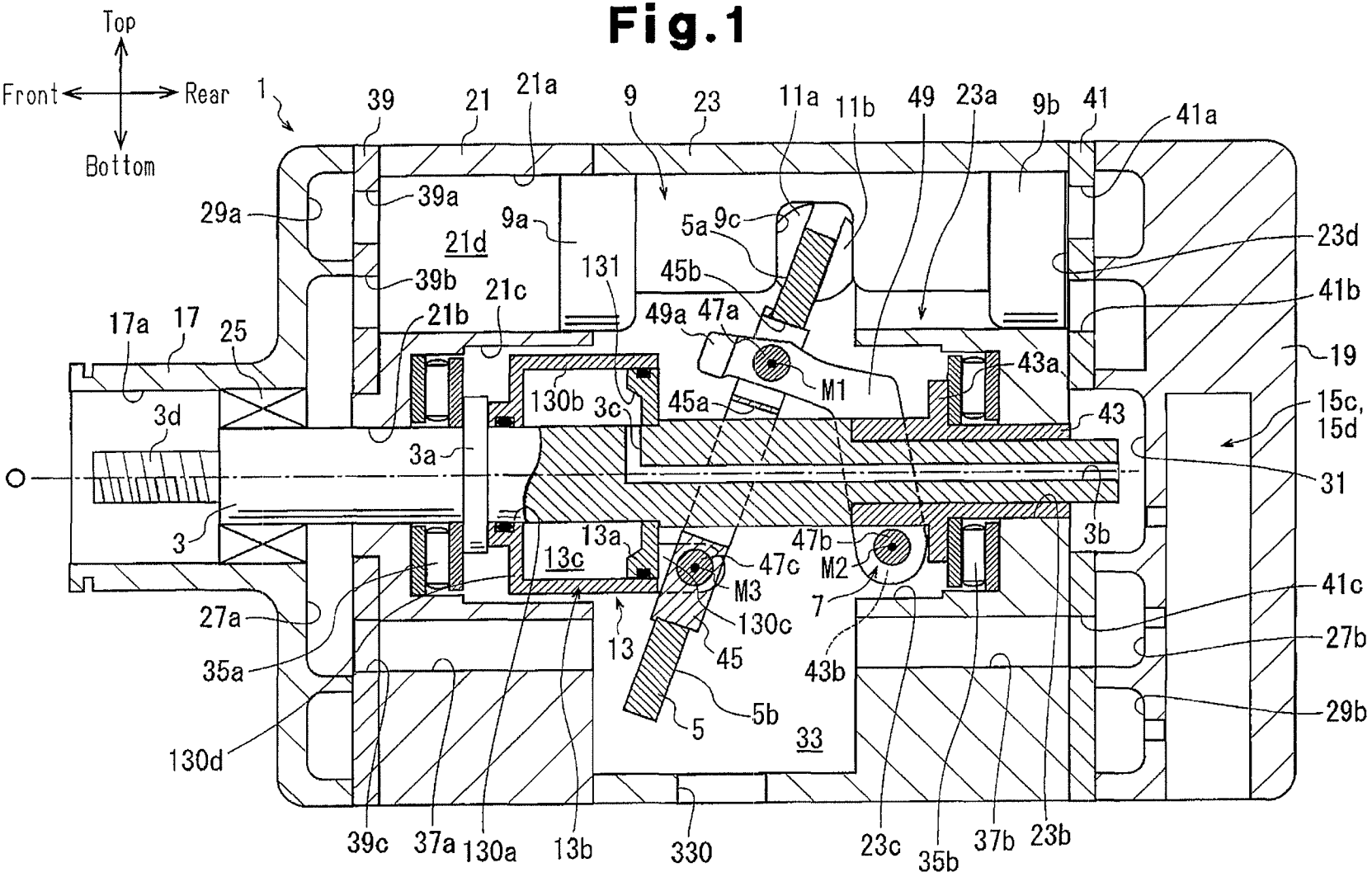
FIG. 1 is a cross-sectional view showing a compressor according to a first embodiment of the present invention in a state corresponding to the maximum displacement.
Figure 2:
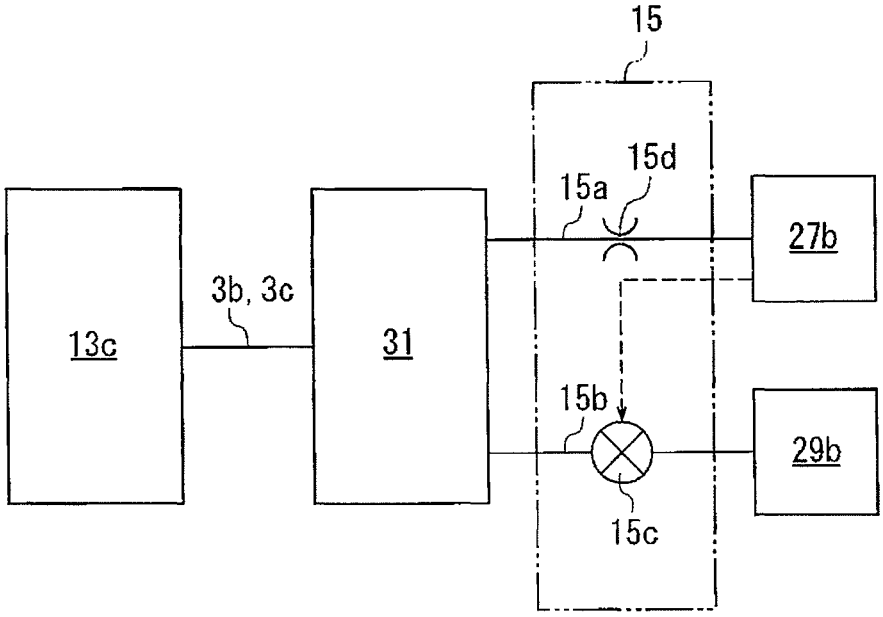
FIG. 2 is a schematic diagram showing a control mechanism of compressors according to first and third embodiments of the invention.
Figure 3:
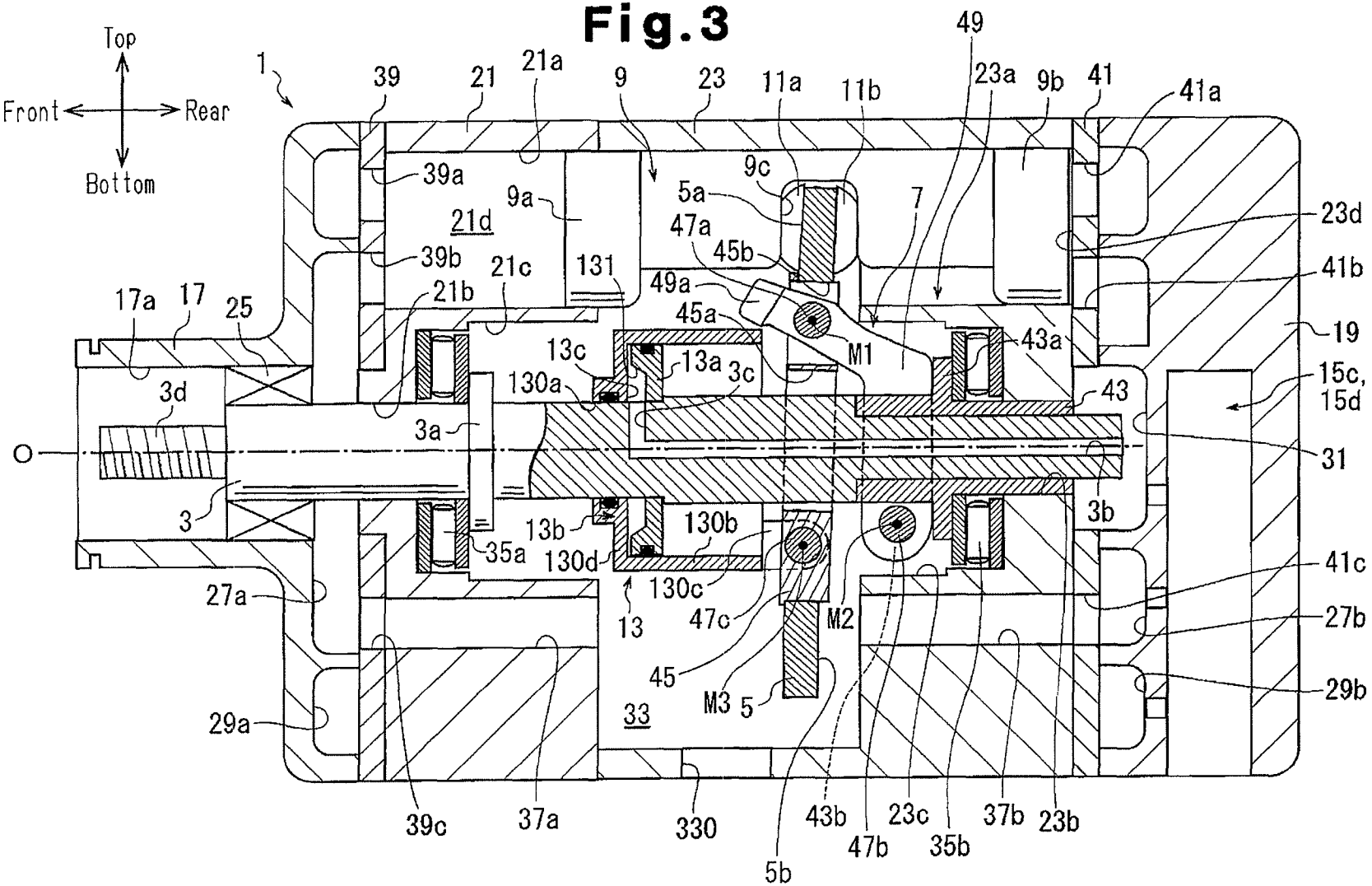
FIG. 3 is a cross-sectional view showing the compressor according to the first embodiment in a state corresponding to the minimum displacement.

As shown in FIGS. 1 and 3, a compressor according to a first embodiment of the invention includes a housing 1, a drive shaft 3, a swash plate 5, a link mechanism 7, a plurality of pistons 9, pairs of front and rear shoes 11*a*, 11*b*, an actuator 13, and a control mechanism 15, which is illustrated in FIG. 2.

With reference to FIG. 1, the housing 1 has a front housing member 17 at a front position in the compressor, a rear housing member 19 at a rear position in the compressor, and a first cylinder block 21 and a second cylinder block 23, which are arranged between the front housing member 17 and the rear housing member 19.

The front housing member 17 has a boss 17*a*, which projects forward. A shaft sealing device 25 is arranged in the boss 17*a* and arranged between the inner periphery of the boss 17*a* and the drive shaft 3. A suction chamber 27*a* and a first discharge chamber 29*a* are formed in the front housing member 17. The first suction chamber 27*a* is arranged at a radially inner position and the first discharge chamber 29*a* is located at a radially outer position in the front housing member 17.

A control mechanism 15 is received in the rear housing member 19. A second suction chamber 27*b*, a second discharge chamber 29*b*, and a pressure regulation chamber 31 are formed in the rear housing member 19. The second suction chamber 27*b* is arranged at a radially inner position and the second discharge chamber 29*b* is located at a radially outer position in the rear housing member 19. The pressure regulation chamber 31 is formed in the middle of the rear housing member 19. The first discharge chamber 29*a* and the second discharge chamber 29*b* are connected to each other through a non-illustrated discharge passage. The discharge passage has an outlet communicating with the exterior of the compressor.

A swash plate chamber 33 is formed by the first cylinder block 21 and the second cylinder block 23. The swash plate chamber 33 is arranged substantially in the middle of the housing 1.

A plurality of first cylinder bores 21*a* are formed in the first cylinder block 21 to be spaced apart concentrically at equal angular intervals, and extend parallel to one another. The first cylinder block 21 has a first shaft hole 21*b*, through which the drive shaft 3 is passed. A first recess 21*c* is formed in the first cylinder block 21 at a position rearward to the first shaft hole 21*b*. The first recess 21*c* communicates with the first shaft hole 21*b* and is coaxial with the first shaft hole 21*b*. The first recess 21*c* communicates with the swash plate chamber 33. A step is formed in an inner peripheral surface of the first recess 21*c*. A first thrust bearing 35*a* is arranged at a front position in the first recess 21*c*. The first cylinder block 21 also includes a first suction passage 37*a*, through which the swash plate chamber 33 and the first suction chamber 27*a* communicate with each other.

As in the first cylinder block 21, a plurality of second cylinder bores 23*a* are formed in the second cylinder block 23. A second shaft hole 23*b*, through which the drive shaft 3 is inserted, is formed in the second cylinder block 23. The second shaft hole 23*b* communicates with the pressure regulation chamber 31. The second cylinder block 23 has a second recess 23*c*, which is located forward to the second shaft hole 23*b* and communicates with the second shaft hole 23*b*. The second recess 23*c* and the second shaft hole 23*b* are coaxial with each other. The second recess 23*c* communicates with the swash plate chamber 33. A step is formed in an inner peripheral surface of the second recess 23*c*. A second thrust bearing 35*b* is arranged at a rear position in the second recess 23*c*. The second cylinder block 23 also has a second suction passage 37*b*, through which the swash plate chamber 33 communicates with the second suction chamber 27*b*.

The swash plate chamber 33 is connected to a non-illustrated evaporator through an inlet 330, which is formed in the second cylinder block 23.

A first valve plate 39 is arranged between the front housing member 17 and the first cylinder block 21. The first valve plate 39 has suction ports 39*b* and discharge ports 39*a*. The number of the suction ports 39*b* and the number of the discharge ports 39*a* are equal to the number of the first cylinder bores 21*a*. A non-illustrated suction valve mechanism is arranged in each of the suction ports 39*b*. Each one of the first cylinder bores 21*a* communicates with the first suction chamber 27*a* via the corresponding one of the suction ports 39*b*. A non-illustrated discharge valve mechanism is arranged in each of the discharge ports 39*a*. Each one of the first cylinder bores 21*a* communicates with the first discharge chamber 29*a* via the corresponding one of the discharge ports 39*a*. A communication hole 39*c* is formed in the first valve plate 39. The communication hole 39*c* allows communication between the first suction chamber 27*a* and the swash plate chamber 33 through the first suction passage 37*a*.

A second valve plate 41 is arranged between the rear housing member 19 and the second cylinder block 23. Like the first valve plate 39, the second valve plate 41 has suction ports 41*b* and discharge ports 41*a*. The number of the suction ports 41*b* and the number of the discharge ports 41*a* are equal to the number of the second cylinder bores 23*a*. A non-illustrated suction valve mechanism is arranged in each of the suction ports 41*b*. Each one of the second cylinder bores 23*a* communicates with the second suction chamber 27*b* via the corresponding one of the suction ports 41*b*. A non-illustrated discharge valve mechanism is arranged in each of the discharge ports 41*a*. Each one of the second cylinder bores 23*a* communicates with the second discharge chamber 29*b* via the corresponding one of the discharge ports 41*a*. A communication hole 41*c* is formed in the second valve plate 41. The communication hole 41*c* allows communication between the second suction chamber 27*b* and the swash plate chamber 33 through the second suction passage 37*b*.

The first suction chamber 27*a* and the second suction chamber 27*b* communicate with the swash plate chamber 33 via the first suction passage 37*a* and the second suction passage 37*b*, respectively. This substantially equalizes the pressure in the first and second suction chambers 27*a*, 27*b* and the pressure in the swash plate chamber 33. More specifically, the pressure in the swash plate chamber 33 is influenced by blow-by gas and thus slightly higher than the pressure in each of the first and second suction chambers 27*a*, 27*b*. The refrigerant gas sent from the evaporator flows into the swash plate chamber 33 via the inlet 330. As a result, the pressure in the swash plate chamber 33 and the pressure in the first and second suction chambers 27*a*, 27*b* are lower than the pressure in the first and second discharge chambers 29*a*, 29*b*. The swash plate chamber 33 is thus a low pressure chamber.

A swash plate 5, an actuator 13, and a flange 3*a* are attached to the drive shaft 3. The drive shaft 3 is passed rearward through the boss 17*a* and received in the first and second shaft holes 21*b*, 23*b* in the first and second cylinder blocks 21, 23. The front end of the drive shaft 3 is thus located inside the boss 17*a* and the rear end of the drive shaft 3 is arranged inside the pressure regulation chamber 31. The drive shaft 3 is supported by the walls of the first and second shaft holes 21*b*, 23*b* in the housing 1 in a manner rotatable about the rotation axis O. The swash plate 5, the actuator 13, and the flange 3*a* are accommodated in the swash plate chamber 33. A flange 3*a* is arranged between the first thrust bearing 35*a* and the actuator 13, or, more specifically, the first thrust bearing 35*a* and a movable body 13*b*, which will be described below. The flange 3*a* prevents contact between the first thrust bearing 35*a* and the movable body 13*b*. A radial bearing may be employed between the walls of the first and second shaft holes 21*b*, 23*b* and the drive shaft 3.

A support member 43 is mounted around a rear portion of the drive shaft 3 in a pressed manner. The support member 43 is a second member. The support member 43 has a flange 43*a*, which contacts the second thrust bearing 35*b*, and an attachment portion 43*b*, through which a second pin 47*b* is passed as will be described below. An axial passage 3*b* is formed in the drive shaft 3 and extends from the rear end toward the front end of the drive shaft 3 in the direction of the rotation axis O. A radial passage 3*c* extends radially from the front end of the axial passage 3*b* and has an opening in the outer peripheral surface of the drive shaft 3. The axial passage 3*b* and the radial passage 3*c* correspond to a communication passage. The rear end of the axial passage 3*b* has an opening in the pressure regulation chamber 31, which is the low pressure chamber. The radial passage 3*c* has an opening in a control pressure chamber 13*c*, which will be described below.

The swash plate 5 is shaped as a flat annular plate and has a front surface 5*a* and a rear surface 5*b*. The front surface 5*a* of the swash plate 5 in the swash plate chamber 33 faces forward in the compressor. The rear surface 5*b* of the swash plate 5 in the swash plate chamber 33 faces rearward in the compressor. The swash plate 5 is fixed to a ring plate 45. The ring plate 45 is a first member. The ring plate 45 is shaped as a flat annular plate and has a through hole 45*a* at the center. As illustrated in FIGS. 1 and 3, by passing the drive shaft 3 through the through hole 45*a*, the swash plate 5 is attached to the drive shaft 3. The swash plate 5 is thus arranged at a position close to the second cylinder bores 23*a* in the swash plate chamber 33, which is a rear position in the swash plate chamber 33.

The link mechanism 7 has a lug arm 49. The lug arm 49 is arranged rearward to the swash plate 5 in the swash plate chamber 33 and located between the swash plate 5 and the support member 43. The lug arm 49 substantially has an L shape. As illustrated in FIG. 3, the lug arm 49 comes into contact with the flange 43*a* of the support member 43 when the inclination angle of the swash plate 5 with respect to the rotation axis O is minimized. This allows the lug arm 49 to maintain the swash plate 5 at the minimum inclination angle in the compressor. A weight portion 49*a* is formed at the distal end of the lug arm 49. The weight portion 49*a* extends in the circumferential direction of the actuator 13 in correspondence with an approximately half the circumference. The weight portion 49*a* may be shaped in any suitable manner.

The distal end of the lug arm 49 is connected to the ring plate 45 through a first pin 47*a*. This configuration supports the distal end of the lug arm 49 to allow the distal end of the lug arm 49 to pivot about the axis of the first pin 47*a*, which is a first pivot axis M1, relative to the ring plate 45, or, in other words, relative to the swash plate 5. The first pivot axis M1 extends perpendicular to the rotation axis O of the drive shaft 3.

The basal end of the lug arm 49 is connected to the support member 43 through a second pin 47*b*. This configuration supports the basal end of the lug arm 49 to allow the basal end of the lug arm 49 to pivot about the axis of the second pin 47*b*, which is a second pivot axis M2, relative to the support member 43, or, in other words, relative to the drive shaft 3. The second pivot axis M2 extends parallel to the first pivot axis M1. The lug arm 49 and the first and second pins 47*a*, 47*b* correspond to the link mechanism 7 according to the present invention.

In the compressor, the swash plate 5 is allowed to rotate together with the drive shaft 3 by connection between the swash plate 5 and the drive shaft 3 through the link mechanism 7. The inclination angle of the swash plate 5 is changed through pivoting of the opposite ends of the lug arm 49 about the first pivot axis M1 and the second pivot axis M2.

The weight portion 49*a* is provided at the opposite side to the second pivot axis M2 with respect to the distal end of the lug arm 49, or, in other words, with respect to the first pivot axis M1. As a result, when the lug arm 49 is supported by the ring plate 45 through the first pin 47*a*, the weight portion 49*a* passes through a groove 45*b* in the ring plate 45 and reaches a position corresponding to the front surface of the ring plate 45, that is, the front surface 5*a* of the swash plate 5. As a result, the centrifugal force produced by rotation of the drive shaft 3 about the rotation axis O is applied to the weight portion 49*a* at the side corresponding to the front surface 5*a* of the swash plate 5.

Pistons 9 each include a first piston head 9*a* at the front end and a second piston head 9*b* at the rear end. The first piston head 9*a* is reciprocally received in the corresponding first cylinder bore 21*a* and forms a first compression chamber 21*d*. The second piston head 9*b* is reciprocally accommodated in the corresponding second cylinder bore 23*a* and forms a second compression chamber 23*d*. Each of the pistons 9 has a recess 9*c*. Each of the recesses 9*c* accommodates semispherical shoes 11*a*, 11*b*. The shoes 11*a*, 11*b* convert rotation of the swash plate 5 into reciprocation of the pistons 9. The shoes 11*a*, 11*b* correspond to a conversion mechanism according to the present invention. The first and second piston heads 9*a*, 9*b* thus reciprocate in the corresponding first and second cylinder bores 21*a*, 23*a* by the stroke corresponding to the inclination angle of the swash plate 5.

The actuator 13 is accommodated in the swash plate chamber 33 at a position forward to the swash plate 5 and allowed to proceed into the first recess 21*c*. The actuator 13 has a rotation body 13*a* and a movable body 13*b*. The rotation body 13*a* is formed in a disk-like shape. The front surface of the rotation body 13*a* includes an inclined surface 131, which is shaped with an inner diameter increasing from the middle of the rotation body 13*a* toward the outer peripheral surface of the rotation body 13*a*. The diameter of the front surface of the rotation body 13*a* thus increases toward the sliding surface between the rotation body 13*a* and the movable body 13*b*. The rotation body 13*a* is fixed to the drive shaft 3. This allows the rotation body 13*a* only to rotate with the drive shaft 3. An O ring is attached to the outer periphery of the movable body 13*b*.

The movable body 13*b* includes a through hole 130*a*, a flange 130*d*, a body portion 130*b*, and an attachment portion 130*c*. The drive shaft 3 is passed through the through hole 130*a*. The flange 130*d* extends radially from the rotation axis O and is arranged around the drive shaft 3. The body portion 130*b* is formed continuously from the flange 130*d* and extends from a front position to a rear position in the movable body 13*b*. The attachment portion 130*c* is formed at the rear end of the body portion 130*b*. The through hole 130*a*, the flange 130*d*, and the body portion 130*b* form the movable body 13*b* in a lidded cylindrical shape. The body portion 130*b* corresponds to the outer peripheral wall of the present invention.

The thickness of the movable body 13*b* is small compared to the thickness of the rotation body 13*a*. The outer diameter of the movable body 13*b* is set not to contact the wall surface of the first recess 21*c* and substantially equal to the diameter of the first recess 21*c*. The movable body 13*b* is arranged between the first thrust bearing 35*a* and the swash plate 5.

The drive shaft 3 extends into the body portion 130*b* of the movable body 13*b* through the through hole 130*a*. The rotation body 13*a* is received in the body portion 130*b* in a manner that permits the body portion 130*b* to slide with respect to the rotation body 13*a*. In other words, the rotation body 13*a* is surrounded by the body portion 130*b*. The movable body 13*b* is rotatable together with the drive shaft 3 and movable in the swash plate chamber 33 in the direction of the rotation axis O of the drive shaft 3. Since the drive shaft 3 is passed through the movable body 13*b*, the movable body 13*b* opposes the link mechanism 7 with the swash plate 5 arranged between the movable body 13*b* and the link mechanism 7. An O ring is mounted in the through hole 130*a*. The drive shaft 3 thus extends through the actuator 13 and allows the actuator 13 to rotate integrally with the drive shaft 3 about the rotation axis O.

The ring plate 45 is connected to the attachment portion 130*c* of the movable body 13*b* through a third pin 47*c*. In this manner, the ring plate 45, or, in other words, the swash plate 5, is supported by the movable body 13*b* such that the ring plate 45, or the swash plate 5, is allowed to pivot about the third pin 47*c*, which is an operation axis M3. The third pin 47*c* through which the attachment portion 130*c* is connected to the ring plate 45, or, in other words, the operation axis M3, is the point of application M3 with which the inclination angle of the swash plate 5 is changed with respect to the rotation axis O of the drive shaft 3. For illustrative purposes, the operation axis and the point of application are referred to with the common reference numeral M3. The operation axis M3 extend parallel to the first and second pivot axes M1, M2. The movable body 13*b* is thus held in a state connected to the swash plate 5. The movable body 13*b* comes into contact with the flange 3*a* when the inclination angle of the swash plate 5 is maximized. As a result, in the compressor, the movable body 13*b* is capable of maintaining the swash plate 5 at the maximum inclination angle.

The control pressure chamber 13*c* is formed between the rotation body 13*a* and the movable body 13*b*. The control pressure chamber 13*c* is surrounded by the body portion 130*b*. The radial passage 3*c* has an opening in the control pressure chamber 13*c*. The control pressure chamber 13*c* communicates with the pressure regulation chamber 31 via the radial passage 3*c* and the axial passage 3*b*.

With reference to FIG. 2, the control mechanism 15 includes a bleed passage 15*a* and a supply passage 15*b* each serving as a control passage, a control valve 15*c*, and an orifice 15*d*.

The bleed passage 15*a* is connected to the pressure regulation chamber 31 and the second suction chamber 27*b*. The pressure regulation chamber 31 communicates with the control pressure chamber 13*c* through the axial passage 3*b* and the radial passage 3*c*. The bleed passage 15*a* thus allows communication between the control pressure chamber 13*c* and the second suction chamber 27*b*. The orifice 15*d* is formed in the bleed passage 15*a* to restrict the amount of the refrigerant gas flowing in the bleed passage 15*a*.

The supply passage 15*b* is connected to the pressure regulation chamber 31 and the second discharge chamber 29*b*. As a result, as in the case of the bleed passage 15*a*, the control pressure chamber 13*c* and the second discharge chamber 29*b* communicate with each other through the supply passage 15*b*, the axial passage 3*b*, and the radial passage 3*c*. In other words, the axial passage 3*b* and the radial passage 3*c* each configure a section in the bleed passage 15*a* and a section in the supply passage 15*b*, each of which serves as the control passage.

The control valve 15*c* is arranged in the supply passage 15*b*. The control valve 15*c* is capable of adjusting the opening degree of the supply passage 15*b* in correspondence with the pressure in the second suction chamber 27*b*. The control valve 15*c* thus adjusts the amount of the refrigerant gas flowing in the supply passage 15*b*. More specifically, when the thermal load in the evaporator drops and thus the pressure in the second suction chamber 27*b* decreases, the control valve 15*c* adjusts its opening degree to reduce the amount of the refrigerant gas flowing in the supply passage 15*b*. A publicly available valve may be employed as the control valve 15*c*.

A threaded portion 3*d* is formed at the distal end of the drive shaft 3. The drive shaft 3 is connected to one of a non-illustrated pulley and the pulley of a non-illustrated electromagnetic clutch through the threaded portion 3*d*. A non-illustrated belt, which is driven by the engine of the vehicle, is wound around one of the pulley and the pulley of the electromagnetic clutch.

A pipe (not shown) extending to the evaporator is connected to the inlet 330. A pipe extending to a condenser (neither is shown) is connected to the outlet. The compressor, the evaporator, an expansion valve, and the condenser configure the refrigeration circuit in the air conditioner for a vehicle.

In the compressor having the above-described configuration, the drive shaft 3 rotates to rotate the swash plate 5, thus reciprocating the pistons 9 in the corresponding first and second cylinder bores 21*a*, 23*a*. This varies the volume of each first compression chamber 21*d* and the volume of each second compression chamber 23*d* in correspondence with the piston stroke. The refrigerant gas is thus drawn from the evaporator into the swash plate chamber 33 via the inlet 330 and sent into the first and second suction chambers 27*a*, 27*b*. The refrigerant gas is then compressed in the first and second compression chambers 21*d*, 23*d* before being sent into the first and second discharge chambers 29*a*, 29*b*. The refrigerant gas is then sent from the first and second discharge chambers 29*a*, 29*b* into the condenser through the outlet.

In the meantime, rotation members including the swash plate 5, the ring plate 45, the lug arm 49, and the first pin 47*a* receive the centrifugal force acting in such a direction as to decrease the inclination angle of the swash plate 5. Through such change of the inclination angle of the swash plate 5, displacement control is carried out by selectively increasing and decreasing the stroke of each piston 9.

Specifically, since the thermal load in the evaporator drops and the pressure in the second suction chamber 27*b* decreases, the control mechanism 15 operates the control valve 15*c*, which is illustrated in FIG. 2, to reduce the amount of the refrigerant gas flowing in the supply passage 15*b*. This increases the amount of the refrigerant gas flowing from the pressure regulation chamber 31 to the second suction chamber 27*b* through the bleed passage 15*a*. The pressure in the control pressure chamber 13*c* is thus substantially equalized with the pressure in the second suction chamber 27*b*. As a result, as the centrifugal force acting on the rotation members moves the movable body 13*b* rearward, the control pressure chamber 13*c* is reduced in size and thus the inclination angle of the swash plate 5 is decreased.

That is, with reference to FIG. 3, when the pressure in the control pressure chamber 13*c* drops and thus the pressure difference between the control pressure chamber 13*c* and the swash plate chamber 33 decreases, the centrifugal force acting on the rotation body moves the movable body 13*b* in the axial direction of the drive shaft 3 in the swash plate chamber 33. As a result, the ring plate 45, or, in other words, the swash plate 5, pivots counterclockwise about the operation axis M3 through the attachment portion 130*c* at the point of application M3, which is the operation axis M3. Also, the distal end of the lug arm 49 pivots clockwise about the first pivot axis M1 and the basal end of the lug arm 49 pivots clockwise about the second pivot axis M2. The lug arm 49 thus approaches the flange 43*a* of the support member 43. This pivots the swash plate 5 with the operation axis M3 serving as the point of application M3 and the first pivot axis M1 serving as the fulcrum M1. For illustrative purposes, the pivot axis and the fulcrum are referred to with the common reference numeral M1.

Such pivot of the swash plate 5 decreases the inclination angle of the swash plate 5 with respect to the rotation axis O of the drive shaft 3 and thus reduces the stroke of each piston 9. As a result, the suction amount and displacement of the compressor per rotation cycle decreases. The inclination angle of the swash plate 5 shown in FIG. 3 corresponds to the minimum inclination angle of the compressor.

The swash plate 5 of the compressor receives the centrifugal force acting on the weight portion 49*a* and thus easily moves in such a direction as to decrease the inclination angle. The movable body 13*b* moves rearward in the axial direction of the drive shaft 3 and the rear end of the movable body 13*b* is arranged inward to the weight portion 49*a*. As a result, when the inclination angle of the swash plate 5 of the compressor is decreased, the weight portion 49*a* overlaps with approximately a half the rear end of the movable body 13*b*.

In contrast, when the thermal load in the evaporator increases and thus the pressure in the second suction chamber 27*b* rises, the control mechanism 15 operates the control valve 15*c*, which is illustrated in FIG. 2, to increase the amount of the refrigerant gas flowing in the supply passage 15*b*. Accordingly, the amount of the refrigerant gas flowing from the second discharge chamber 29*b* into the pressure regulation chamber 31 through the supply passage 15*b* is increased, in contrast to the case for decreasing the compressor displacement. The pressure in the control pressure chamber 13*c* is thus substantially equalized with the pressure in the second discharge chamber 29*b*. This moves the movable body 13*b* of the actuator 13 forward against the centrifugal force acting on the rotation members. The volume of the control pressure chamber 13*c* is thus increased and the inclination angle of the swash plate 5 is increased.

That is, with reference to FIG. 1, since the pressure in the control pressure chamber 13*c* exceeds the pressure in the swash plate chamber 33, the movable body 13*b* moves forward in the swash plate chamber 33 in the axial direction of the drive shaft 3. The movable body 13*b* thus pulls the lower end of the swash plate 5, as viewed in FIG. 1, to a front position in the swash plate chamber 33 through the attachment portion 130*c* at the operation axis M3. This pivots the swash plate 5 clockwise about the operation axis M3. Also, the distal end of the lug arm 49 pivots counterclockwise about the first pivot axis M1 and the basal end of the lug arm 49 pivots counterclockwise about the second pivot axis M2. The lug arm 49 is thus separated from the flange 43*a* of the support member 43. This pivots the swash plate 5 in the opposite direction to the direction in the case where the inclination angle decreases with the operation axis M3 and the first pivot axis M1 serving as the point of application M3 and the fulcrum M1, respectively. The inclination angle of the swash plate 5 with respect to the rotation axis O of the drive shaft 3 is thus increased. This increases the stroke of each piston 9, thus raising the suction amount and displacement of the compressor per rotation cycle. Specifically, the inclination angle of the swash plate 5 illustrated in FIG. 1 is the maximum inclination angle of the compressor.

As has been described, by applying the pressure in the second discharge chamber 29*b* to the control pressure chamber 13*c* through the supply passage 15*b*, the pressure regulation chamber 31, the axial passage 3*b*, and the radial passage 3*c*, the compressor increases the pressure in the control pressure chamber 13*c* compared to the pressure in the swash plate chamber 33. This allows the movable body 13*b* of the compressor to increase the inclination angle of the swash plate 5 rapidly.

The movable body 13*b* of the compressor has the flange 130*d* and the body portion 130*b*, which is formed continuously from the flange 130*d*. The body portion 130*b* is movable back and forth in the direction of the rotation axis O relative to the outer circumference of the rotation body 13*a*. This allows the movable body 13*b* to increase the inclination angle of the swash plate 5 using the pulling force by which the movable body 13*b* pulls the swash plate 5 and decrease the inclination angle of the swash plate 5 using the pressing force by which the movable body 13*b* presses the swash plate 5.

The attachment portion 130*c* of the body portion 130*b* has the point of application M3 connected to the swash plate 5. The pulling force or the pressing force applied by the movable body 13*b* is thus transmitted directly to the swash plate 5 to change the inclination angle of the swash plate 5. This facilitates desirable change of the inclination angle of the swash plate 5 through the actuator 13.

The rotation body 13*a* has the inclined surface 131. The inner diameter of the front surface of the rotation body 13*a* increases from the middle toward the outer peripheral surface of the rotation body 13*a*.

As a result, in the compressor, the lubricant contained in the refrigerant gas flowing into the control pressure chamber 13*c* is dispersed onto the inner peripheral surface of the rotation body 13*a* and the inner peripheral surface of the movable body 13*b* by the centrifugal force produced through rotation of the rotation body 13*a* and the movable body 13*b* together with the drive shaft 3. Also, the inclined surface 131, the diameter of which increases toward the sliding surface between the rotation body 13*a* and the movable body 13*b*, readily guides the lubricant onto the sliding surface. As a result, insufficient lubrication is not likely to occur on the sliding surface between the rotation body 13*a* and the movable body 13*b*. Further, since blockage of the radial passage 3*c* by the lubricant does not happen easily, desirable communication of the refrigerant gas between the pressure regulation chamber 31 and the control pressure chamber 13*c* is allowed.

As a result, the compressor is capable of rapidly controlling its displacement including not only increase but also decrease of the displacement.

The compressor also includes the axial passage 3*b* and the radial passage 3*c* in the drive shaft 3. In this configuration, the lubricant contained in the refrigerant gas flowing into the control pressure chamber 13*c* is dispersed in the control pressure chamber 13*c* in radially outward directions of the drive shaft 3 through the radial passage 3*c* by the centrifugal force generated through the rotation of the rotation body 13*a* and the movable body 13*b* together with the drive shaft 3. This makes it difficult for the lubricant to stagnate in the proximity of the radial passage 3*c* and the axial passage 3*b* and the radial passage 3*c* are not easily blocked by the lubricant. Desirable communication of the refrigerant gas between the pressure regulation chamber 31 and the control pressure chamber 13*c* is thus allowed. Further, the axial passage 3*b* and the radial passage 3*c* configure a communication passage in the compressor, thus simplifying the configuration of the communication passage. The compressor is thus reduced in size.

By controlling the control valve 15*c* to open, the control mechanism 15 applies the pressure in the second discharge chamber 29*b* into the pressure regulation chamber 31. As a result, the compressor is capable of switching particularly from a state in which the compressor displacement is decreased to a state in which the displacement is increased in a desirable manner.

The control valve 15*c* lowers the pressure in the pressure regulation chamber 31 through decrease of the pressure in the second suction chamber 27*b*. As a result, a vehicle having a refrigerating circuit configured using the compressor ensures air conditioning in the passenger compartment corresponding to a cooling request.

The compressor brings about a muffler effect by using the swash plate chamber 33 as a refrigerant gas passage to the first and second suction chambers 27*a*, 27*b*. This decreases suction pulsation in the refrigerant gas and thus decreases the noise produced by the compressor.

Second Embodiment

Figure 4:
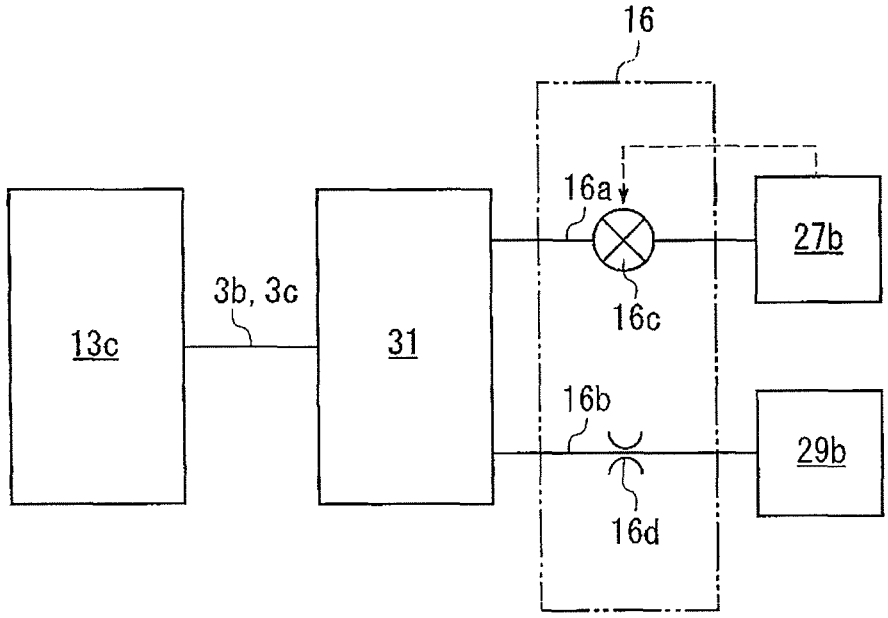
FIG. 4 is a schematic diagram showing a control mechanism of compressors according to second and fourth embodiments of the invention.

A compressor according to a second embodiment of the invention includes a control mechanism 16 illustrated in FIG. 4, instead of the control mechanism 15 of the compressor of the first embodiment. The control mechanism 16 includes a bleed passage 16*a* and a supply passage 16*b* each serving as a control passage, a control valve 16*c*, and an orifice 16*d*.

The bleed passage 16*a* is connected to the pressure regulation chamber 31 and the second suction chamber 27*b*. This configuration allows the bleed passage 16*a* to ensure communication between the control pressure chamber 13*c* and the second suction chamber 27*b*. The supply passage 16*b* is connected to the pressure regulation chamber 31 and the second discharge chamber 29*b*. The control pressure chamber 13*c* and the pressure regulation chamber 31 thus communicate with the second discharge chamber 29*b* through the supply passage 16*b*. The orifice 16*d* is formed in the supply passage 16*b* to restrict the amount of the refrigerant gas flowing in the supply passage 16*b*.

The control valve 16*c* is arranged in the bleed passage 16*a*. The control valve 16*c* is capable of adjusting the opening degree of the bleed passage 16*a* in correspondence with the pressure in the second suction chamber 27*b*. The control valve 16*c* thus adjusts the amount of the refrigerant flowing in the bleed passage 16*a*. As in the case of the aforementioned control valve 15*c*, a publicly available product may be employed as the control valve 16*c*. The axial passage 3*b* and the radial passage 3*c* each configure a section of the bleed passage 16*a* and a section of the supply passage 16*b*. The other components of the compressor of the second embodiment are configured identically with the corresponding components of the compressor of the first embodiment. Accordingly, these components are referred to using common reference numerals and detailed description thereof is omitted herein.

In the control mechanism 16 of the compressor, if the control valve 16*c* decreases the amount of the refrigerant gas flowing in the bleed passage 16*a*, the flow of refrigerant gas from the second discharge chamber 29*b* into the pressure regulation chamber 31 via the supply passage 16*b* and the orifice 16*d* is promoted. This substantially equalizes the pressure in the control pressure chamber 13*c* to the pressure in the second discharge chamber 29*b*. The movable body 13*b* of the actuator 13 thus moves forward against the centrifugal force acting on the rotation member. This increases the volume of the control pressure chamber 13*c*, thus increasing the inclination angle of the swash plate 5.

In the compressor of the second embodiment, the inclination angle of the swash plate 5 is increased to increase the stroke of each piston 9, thus raising the suction amount and displacement of the compressor per rotation cycle, as in the case of the compressor according to the first embodiment (see FIG. 1).

In contrast, if the control valve 16*c* illustrated in FIG. 4 increases the amount of the refrigerant gas flowing in the bleed passage 16*a*, refrigerant gas from the second discharge chamber 29*b* is less likely to flow into and be stored in the pressure regulation chamber 31 through the supply passage 16*b* and the orifice 16*d*. This substantially equalizes the pressure in the control pressure chamber 13*c* to the pressure in the second suction chamber 27*b*. The movable body 13*b* is thus moved rearward by the centrifugal force acting on the rotation body. This reduces the volume of the control pressure chamber 13*c*, thus decreasing the inclination angle of the swash plate 5.

As a result, by decreasing the inclination angle of the swash plate 5 and thus the stroke of each piston 9, the suction amount and displacement of the compressor per rotation cycle are lowered (see FIG. 3).

As has been described, the control mechanism 16 of the compressor of the second embodiment adjusts the opening degree of the bleed passage 16*a* by means of the control valve 16*c*. The compressor thus slowly lowers the pressure in the control pressure chamber 13*c* using the low pressure in the second suction chamber 27*a* to maintain desirable driving comfort of the vehicle. The other operations of the compressor of the second embodiment are the same as the corresponding operations of the compressor of the first embodiment.

Third Embodiment

Figure 5:
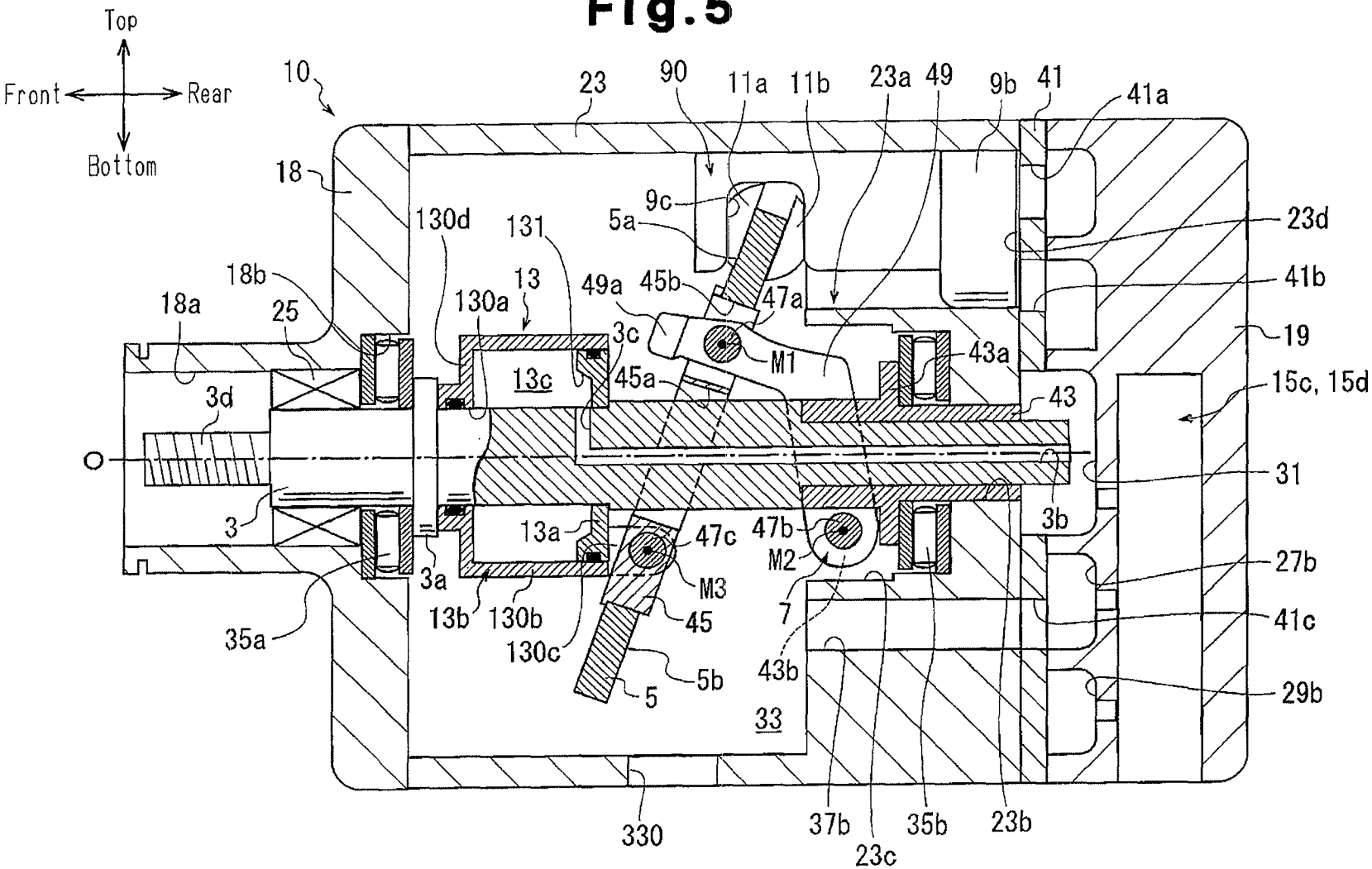
FIG. 5 is a cross-sectional view showing a compressor according to a third embodiment of the invention in a state corresponding to the maximum displacement.
Figure 6:
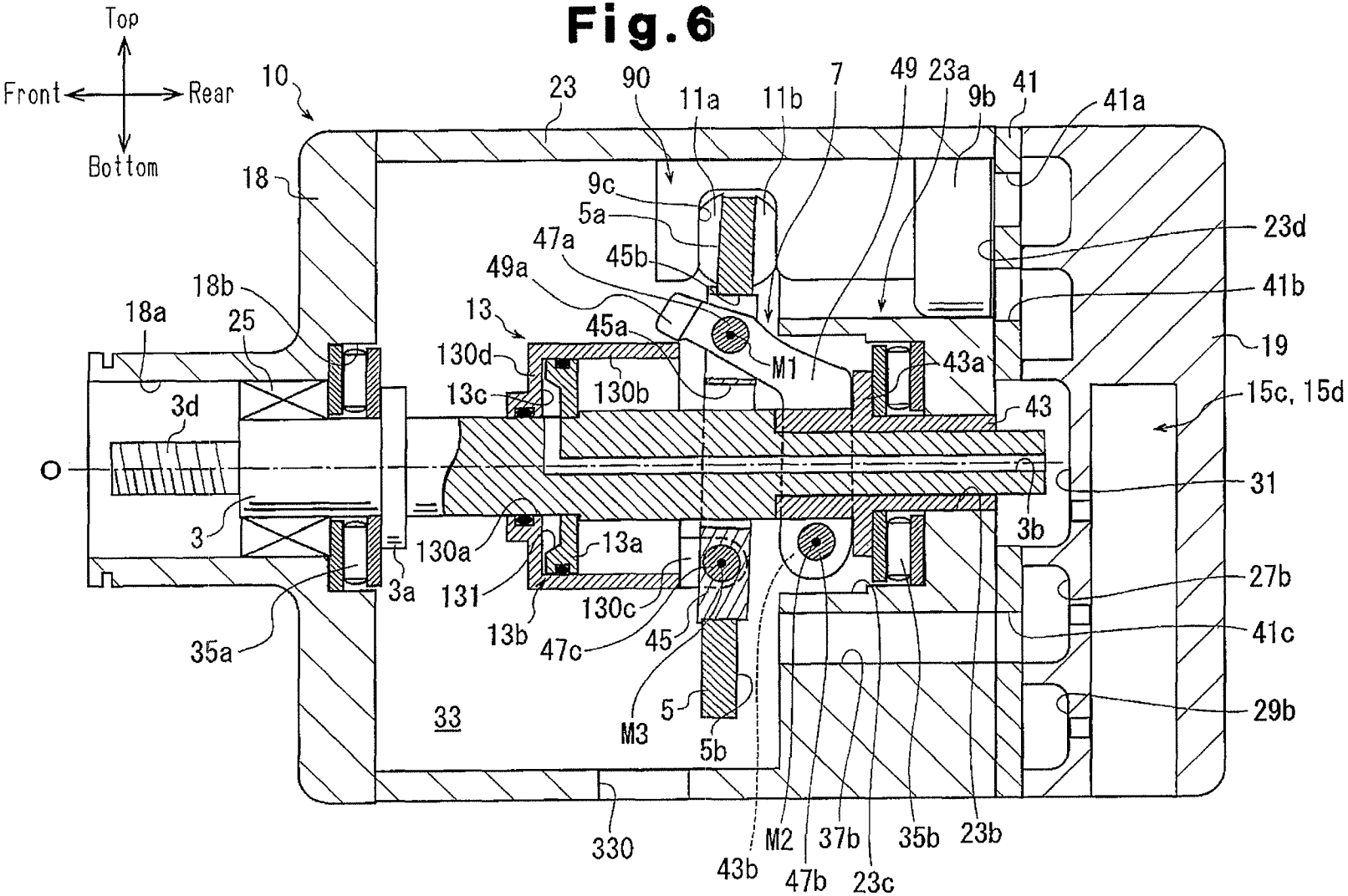
FIG. 6 is a cross-sectional view showing the compressor according to the third embodiment in a state corresponding to the minimum displacement.

As illustrated in FIGS. 5 and 6, a compressor according to a third embodiment of the invention includes a housing 10 and pistons 90, instead of the housing 1 and the pistons 9 of the compressor of the first embodiment.

The housing 10 has a front housing member 18, in addition to the rear housing member 19 and the second cylinder block 23, which are the same components as those of the first embodiment. The front housing member 18 has a boss 18*a* projecting forward and a recess 18*b*. The shaft sealing device 25 is mounted in the boss 18*a*. Unlike the front housing member 17 of the first embodiment, the front housing member 18 includes neither the first suction chamber 27*a* nor the first discharge chamber 29*a*.

In the compressor, the swash plate chamber 33 is formed by the front housing member 18 and the second cylinder block 23. The swash plate chamber 33 is arranged substantially in the middle of the housing 10 and communicates with the second suction chamber 27*b* via the second suction passage 37*b*. The first thrust bearing 35*a* is arranged in the recess 18*b* of the front housing member 18.

Unlike the pistons 9 of the first embodiment, each of the pistons 90 only has the piston head 9*b* at the rear end of the piston 90. The other components of each piston 90 and the other components of the compressor of the third embodiment are configured identically with the corresponding components of the first embodiment. For illustrative purposes, the second cylinder bore 23*a*, the second compression chamber 23*d*, the second suction chamber 27*b*, and the second discharge chamber 29*b* of the first embodiment will be referred to as the cylinder bore 23*a*, the compression chamber 23*d*, the suction chamber 27*b*, and the discharge chamber 29*b* in the following description about the third embodiment.

In the compressor of the third embodiment, the drive shaft 3 rotates to rotate the swash plate 5, thus reciprocating the pistons 90 in the corresponding cylinder bores 23*a*. The volume of each compression chamber 23*d* is thus varied in correspondence with the piston stroke. Correspondingly, refrigerant gas is drawn from the evaporator into the swash plate chamber 33 through the inlet 330, reaches each compression chamber 23*d* via the suction chamber 27*b* for compression, and sent into the discharge chamber 29*b*. The refrigerant gas is then supplied from the discharge chamber 29*b* to the condenser through a non-illustrated outlet.

Like the compressor of the first embodiment, the compressor of the third embodiment is capable of executing displacement control by changing the inclination angle of the swash plate 5 to selectively increase and decrease the stroke of each piston 90.

As illustrated in FIG. 6, when the difference between the pressure in the control pressure chamber 13*c* and the pressure in the swash plate chamber 33 decreases, the movable body 13*b* is moved rearward in the swash plate chamber 33 in the axial direction of the drive shaft 3 by the centrifugal force acting on the swash plate 5, the ring plate 45, the lug arm 49, and the first pin 47*a* each serving as a rotation member. As a result, as in the first embodiment, the swash plate 5 pivots using the operation axis M3 as the point of application M3 and the first pivot axis M1 as the fulcrum M1. This decreases the inclination angle of the swash plate 5 and thus reduces the stroke of each piston 90, decreasing the suction amount and displacement of the compressor per rotation cycle. The inclination angle of the swash plate 5 shown in FIG. 6 corresponds to the minimum inclination angle in the compressor.

With reference to FIG. 5, when the pressure in the control pressure chamber 13*c* exceeds the pressure in the swash plate chamber 33, the movable body 13*b* is moved forward in the swash plate chamber 33 in the axial direction of the drive shaft 3 against the centrifugal force acting on the rotation members. The movable body 13*b* thus pulls the swash plate 5 forward in the swash plate chamber 33 through the first pin 47*a*. As a result, the swash plate 5 pivots in the opposite direction to the direction in the above-described case where the inclination angle decreases with the operation axis M3 and the first pivot axis M1 serving as the point of application M3 and the fulcrum M1, respectively. This increases the inclination angle of the swash plate 5 and thus increases the stroke of each piston 90. The suction amount and displacement of the compressor per rotation cycle are thus raised. The inclination angle of the swash plate 5 shown in FIG. 5 corresponds to the maximum inclination angle in the compressor.

The compressor of the third embodiment is formed without the first cylinder block 21 and thus has a simple configuration compared to the compressor of the first embodiment. As a result, the compressor of the third embodiment is further reduced in size. The other operations of the third embodiment are the same as those of the first embodiment.

Fourth Embodiment

A compressor according to a fourth embodiment of the present invention is the compressor according to the third embodiment employing the control mechanism 16 illustrated in FIG. 4. The compressor of the fourth embodiment operates in the same manners as the compressors of the second and third embodiments.

Although the present invention has been described referring to the first to fourth embodiments, the invention is not limited to the illustrated embodiments, but may be modified as necessary without departing from the scope of the invention.

For example, in the first to fourth embodiments, the inclined surface 131 is formed on the front surface of the rotation body 13*a* such that the diameter of the rotation body 13*a* increases toward the sliding surface between the rotation body 13*a* and the movable body 13*b*. However, an inclined surface may be formed in the inner peripheral surface of the body portion 130*b* of the rotation body 13*a* to incline from a front position toward a rear position such that the diameter of the movable body 13*b* increases toward the sliding surface between the movable body 13*b* and the rotation body 13*a*.

In the compressors of the first to fourth embodiments, refrigerant gas is sent into the first and second suction chambers 27*a*, 27*b* via the swash plate chamber 33. However, the refrigerant gas may be drawn into the first and second suction chambers 27*a*, 27*b* directly from the corresponding pipe through the inlet. In this case, the compressor should be configured to allow communication between the first and second suction chambers 27*a*, 27*b* and the swash plate chamber 33 so that the swash plate chamber 33 corresponds to a low pressure chamber.

The compressors of the first to fourth embodiments may be configured without the pressure regulation chamber 31.

In the compressor according to the present invention, the movable body may include an outer peripheral wall that surrounds the rotation body and the control pressure chamber. It is preferable that the outer peripheral wall of the movable body have a point of application connected to the swash plate. In this case, the outer peripheral wall of the movable body and the swash plate are connected to each other at the point of application. The force applied by the movable body is thus transmitted directly to the swash plate to change the inclination angle. As a result, the actuator of the compressor easily changes the inclination angle of the swash plate in a desirable manner and the displacement control is performed further rapidly.

It is preferable that the control passage formed in the drive shaft include a communication passage configured by an axial passage extending in the drive shaft in the direction of the rotation axis and a radial passage communicating with the axial passage and extending radially in the drive shaft to communicate with the control pressure chamber.

In this case, the lubricant contained in the refrigerant gas flowing into the control pressure chamber is dispersed in the control pressure chamber in radially outward directions through the radial passage of the communication passage by the centrifugal force produced through rotation of the rotation body and the movable body together with the drive shaft. This makes it difficult for the refrigerant to stagnate in the proximity of the radial passage of the communication passage. The communication passage is thus not readily blocked by the lubricant. This allows desirable communication of the refrigerant gas with respect to the control passage in the compressor. Also, the communication passage, which is a section in the control passage, is configured simply. It is thus easy to form the communication passage in the drive shaft.

It is preferable that at least a portion of the inner peripheral surface of at least one of the rotation body and the movable body have a diameter becoming greater toward the sliding surface between the rotation body and the movable body.

In this case, the lubricant contained in the refrigerant gas flowing into the control pressure chamber is dispersed onto the inner peripheral surface of the rotation body and the inner peripheral surface of the movable body by the centrifugal force generated through rotation of the rotation body and the movable body together with the drive shaft. The lubricant is also guided easily to the sliding surface by the inner peripheral surface the diameter of which increases toward the sliding surface. Insufficient lubrication is thus unlikely to occur on the sliding surface between the rotation body and the movable body.

The movable body may include a flange extending radially from the periphery of the drive shaft in a direction separating from the rotation axis. The outer peripheral wall of the movable body may be formed integrally with the flange at the outer circumference of the flange and extend in the direction of the rotation axis of the drive shaft. It is preferable that the outer peripheral wall be movable in the direction of the rotation axis relative to the outer circumference of the rotation body.

In this case, when the outer peripheral wall moves in the direction of the rotation axis of the movable body, the movable body applies one of pulling force and pressing force onto the swash plate at the point of application. As a result, the inclination angle of the swash plate is changed by one of the pulling force and the pressing force.

It is preferable that the control valve lower the pressure in the pressure regulation chamber through a decrease of the thermal load. In this case, when the thermal load decreases, the inclination angle of the swash plate is reduced to decrease the compressor displacement per rotation cycle. In this manner, the compressor controls its displacement in correspondence with the thermal load.

The invention claimed is:

1. A swash plate type variable displacement compressor comprising:

a housing in which a suction chamber, a discharge chamber, a swash plate chamber, and a cylinder bore are formed;

a drive shaft rotationally supported by the housing;

a swash plate rotatable in the swash plate chamber by rotation of the drive shaft;

a link mechanism arranged between the drive shaft and the swash plate, the link mechanism allowing change of an inclination angle of the swash plate with respect to a line perpendicular to the rotation axis of the drive shaft;

a piston reciprocally received in the cylinder bore;

a conversion mechanism that causes the piston to reciprocate in the cylinder bore by a stroke corresponding to the inclination angle of the swash plate through rotation of the swash plate;

an actuator capable of changing the inclination angle of the swash plate; and a control mechanism that controls the actuator, wherein the actuator is arranged in the swash plate chamber and rotates integrally with the drive shaft, the actuator includes a rotation body fixed to the drive shaft, a movable body that is connected to the swash plate and movable relative to the rotation body in the direction of the rotation axis of the drive shaft, and a control pressure chamber that is defined by the rotation body and the movable body and moves the movable body using pressure in the control pressure chamber, wherein the rotation body is slidably located within the movable body and the movable body is configured to move along the rotation axis of the drive shaft, one of the suction chamber and the swash plate chamber is a low pressure chamber, the control mechanism has a control passage through which the control pressure chamber communicates with the low pressure chamber and the discharge chamber and a control valve capable of adjusting the opening degree of the control passage, at least a section of the control passage is formed in the drive shaft, and the movable body is arranged such that the inclination angle of the swash plate is increased through a rise of the pressure in the control pressure chamber.

2. The compressor according to claim 1, wherein the movable body has an outer peripheral wall that surrounds the rotation body and the control pressure chamber, and the outer peripheral wall has a point of application connected to the swash plate.

3. The compressor according to claim 1, wherein the control passage formed in the drive shaft is configured by a axial passage extending in the drive shaft in the direction of the rotation axis and a radial passage communicating with the axial passage and extending radially in the drive shaft to communicate with the control pressure chamber.

4. The compressor according to claim 1, wherein at least a portion of the inner peripheral surface of at least one of the rotation body and the movable body has a diameter becoming greater toward a sliding surface between the rotation body and the movable body.

5. The compressor according to claim 2, wherein the movable body has a flange extended radially from the rotation axis of the drive shaft and arranged around the drive shaft, the outer peripheral wall of the movable body is formed integrally with the flange at the outer circumference of the flange and extends along the rotation axis of the drive shaft, and the outer peripheral wall is movable along the rotation axis of the drive shaft relative to the outer circumference of the rotation body.

6. The compressor according to claim 1, wherein a pressure regulation chamber is formed in the control passage, and the control valve lowers the pressure in the pressure regulation chamber by a decrease in thermal load.

7. The compressor according to claim 1, wherein a radially central axis of the control pressure chamber coincides with the rotation axis of the drive shaft.

* * * * *